US012618009B2

(12) United States Patent
Langlois et al.

(10) Patent No.: US 12,618,009 B2
(45) Date of Patent: May 5, 2026

(54) PYROLYSIS SYSTEM FOR CONVERTING CARBONEOUS MATERIALS INTO BIOCHAR AND METHOD FOR OPERATING SAME

(71) Applicant: XYLO-CARBONE INC., St-Tite (CA)

(72) Inventors: Simon Langlois, Pont-Rouge (CA); Antoine Langlois, Saint-Jean-Port-Joli (CA); Dominic Lord, Québec (CA)

(73) Assignee: XYLO-CARBONE INC., St-Tite (CA)

( * ) Notice: Subject to any disclaimer, the term of this patent is extended or adjusted under 35 U.S.C. 154(b) by 410 days.

(21) Appl. No.: 18/221,115

(22) Filed: Jul. 12, 2023

(65) Prior Publication Data

US 2024/0018417 A1 Jan. 18, 2024

Related U.S. Application Data

(60) Provisional application No. 63/389,404, filed on Jul. 15, 2022.

(51) Int. Cl.
*C10B 1/04* (2006.01)
*C10B 21/20* (2006.01)
(Continued)

(52) U.S. Cl.
CPC ..... *C10B 53/02* (2013.01); *C10B 1/04* (2013.01); *C10B 21/20* (2013.01); *C10B 47/06* (2013.01); *C10B 47/18* (2013.01); *C10B 47/20* (2013.01)

(58) Field of Classification Search
CPC ..... C10B 1/04; C10B 3/02
See application file for complete search history.

(56) References Cited

U.S. PATENT DOCUMENTS 704,886 A * 7/1902 Larsen ..... C10B 1/04 202/124
1,278,180 A * 9/1918 McDonald ..... C10B 1/04 48/209

(Continued)

FOREIGN PATENT DOCUMENTS

CA 3225246 A1 11/2013
CA 3038166 3/2018

(Continued)

OTHER PUBLICATIONS

PE2E translation of CN-107384455-A.*
Extended European Search Report, May 5, 2024, European Patent Office.

*Primary Examiner* — Jonathan Luke Pilcher
(74) *Attorney, Agent, or Firm* — NORTON ROSE FULBRIGHT CANADA LLP

(57) ABSTRACT

There is described a pyrolysis system for converting carboneous materials into biochar including a kiln, a retort, and a gas recovery system including a combustor supplying hot air to the kiln, a conduit fluidly connected between the retort and the combustor, the conduit conveying the pyrolysis gas and residues from a chamber of the retort to the combustor, and a filter cartridge fluidly connecting the chamber of the retort to the conduit for filtering the pyrolysis gas and the residues conveyed from the chamber of the retort to the combustor, the filter cartridge removably located inside the conduit and extending at least partially inside the chamber of the retort. Methods for operating the pyrolysis system are also described. The pyrolysis system and methods described herein produce biochar with improved resistance to self-heating.

15 Claims, 8 Drawing Sheets

(51) Int. Cl.

| | |
|---|---|
| ***C10B 47/06*** | (2006.01) |
| ***C10B 47/18*** | (2006.01) |
| ***C10B 47/20*** | (2006.01) |
| ***C10B 53/02*** | (2006.01) |

(56) References Cited

U.S. PATENT DOCUMENTS

| | | | | | |
|---|---|---|---|---|---|
| 1,281,320 | A | * | 10/1918 | Erickson | C10B 1/04 202/124 |
| 1,713,032 | A | * | 5/1929 | Debauche | C10B 1/04 202/124 |
| 1,733,747 | A | * | 10/1929 | Mcintire | C10B 3/02 202/126 |
| 3,736,248 | A | * | 5/1973 | Hussong | C10B 55/00 422/198 |
| 4,409,068 | A | * | 10/1983 | Davis | C10L 9/08 202/95 |
| 5,821,396 | A | | 10/1998 | Bouziane | |
| 8,945,348 | B2 | | 2/2015 | Loiseau et al. | |
| 2010/0223848 | A1 | | 9/2010 | Heidenreich | |
| 2011/0278150 | A1 | | 11/2011 | Mulqueen et al. | |
| 2012/0266529 | A1 | | 10/2012 | Scahill et al. | |
| 2022/0290052 | A1 | * | 9/2022 | Goncalves | C10B 47/06 |
| 2025/0361940 | A1 | * | 11/2025 | Lord | F16K 3/0281 |

FOREIGN PATENT DOCUMENTS

| | | | | | |
|---|---|---|---|---|---|
| CA | 2859599 | C | | 8/2019 | |
| CA | 3103596 | A1 | | 12/2019 | |
| CA | 2874789 | C | | 7/2020 | |
| CA | 3195363 | A1 | | 3/2022 | |
| CA | 3201489 | A1 | | 5/2022 | |
| CA | 3205925 | A1 | | 7/2022 | |
| CA | 3205937 | A1 | | 7/2022 | |
| CA | 3207965 | A1 | | 8/2022 | |
| CA | 3216762 | A1 | | 11/2022 | |
| CA | 3216793 | A1 | | 11/2022 | |
| CA | 3225723 | A1 | | 1/2023 | |
| CA | 3225978 | A1 | | 1/2023 | |
| CA | 3226129 | A1 | | 1/2023 | |
| CA | 3227528 | A1 | | 2/2023 | |
| CA | 3227529 | A1 | | 2/2023 | |
| CA | 3237206 | A1 | | 5/2023 | |
| CA | 3084690 | C | | 9/2023 | |
| CA | 3254493 | A1 | | 9/2023 | |
| CN | 107384455 | A | * | 11/2017 | C10B 53/02 |
| CN | 206853453 | | | 1/2018 | |
| CN | 216155791 | | | 4/2022 | |
| CN | 216572559 | | | 5/2022 | |
| DE | 2832414 | | | 1/1980 | |
| DE | 102010047320 | | | 4/2012 | |
| EP | 3763803 | | | 1/2021 | |
| EP | 3901519 | | | 10/2021 | |
| IT | 201800006013 | | | 12/2019 | |
| WO | 2010132970 | | | 11/2010 | |

* cited by examiner

PYROLYSIS SYSTEM FOR CONVERTING CARBONEOUS MATERIALS INTO BIOCHAR AND METHOD FOR OPERATING SAME

CROSS-REFERENCE

The present application claims priority to U.S. Patent Application Ser. No. 63/389,404 titled "Process for Producing Biocoal Integrating A Gas Recovery System" and filed on Jul. 15, 2022, the contents of which is incorporated-by-reference herein in its entirety.

TECHNICAL FIELD

The present technology relates to systems for converting carboneous materials into biochar and to methods for operating the same, and more particularly to systems for producing biochar with a gas recovery system.

BACKGROUND

There exists a wide variety of systems for producing biochar, also known as biocoal. Typically, these systems heat batches of carboneous materials, such as wood chips, into kilns until the carboneous materials are turned into biochar with the desired properties. These batch-type systems require the handling of relatively large retorts that need to be placed and heated up in a kiln with low oxygen concentration, and then withdrawn and cooled down, which leads to increased production downtime.

Other systems for producing biochar use a horizontally-extending rotary auger screw for feeding the carboneous materials into a horizontal kiln, and allows for continuous production of biochar. However, moving parts of the system, such as the auger screw, are exposed to highly acidic conditions from the tarry by-products generated during the pyrolysis cycle and are likely to undergo thermal fatigue due to the high temperature of 300° C. up to 900° C. necessary for controlling the thermo-conversion by pyrolysis of the carboneous materials into biochar.

Therefore, in spite of previous efforts, there seems to be some room for improvement in the art for systems and methods for producing biochar that reduces the aforementioned drawbacks.

SUMMARY

In one aspect, there is provided a pyrolysis system for converting carboneous materials into biochar including a kiln adapted for containing hot air, a retort located inside the kiln and affixed to the kiln, the retort including an inlet for filling a chamber of the retort with the carboneous materials, and an outlet located vertically below the inlet for emptying the biochar from the chamber of the retort through gravity, the retort defining a port fluidly connected to the chamber for conveying pyrolysis gas and residues out of the retort, and a gas recovery system including a combustor supplying the hot air to the kiln via a hot air line fluidly connected from the combustor to the kiln, a conduit fluidly connected between the port of the retort and the combustor, the conduit conveying the pyrolysis gas and residues from the chamber of the retort to the combustor, and a filter cartridge fluidly connecting the chamber of the retort to the conduit for filtering the pyrolysis gas and the residues conveyed from the chamber of the retort to the combustor, the filter cartridge removably located inside the conduit and extending through the port at least partially inside the chamber of the retort.

In one embodiment, the retort includes an inlet valve on the inlet and an outlet valve on the outlet, and during pyrolysis, hot air flowing in the kiln is isolated from the carboneous materials, the pyrolysis gas and the residues inside located inside the chamber of the retort.

In one embodiment, the retort is configured for indirect heat transfer from the hot air flowing inside the kiln to the carboneous materials located inside the chamber of the retort.

In one embodiment, the kiln has an inner wall, the retort has an outer wall spaced inwardly from the inner wall of the kiln, the inner wall of the kiln and the outer wall of the retort defining a hot air plenum between the inner wall of the kiln and the outer wall of the retort.

In one embodiment, the pyrolysis system further includes a sleeve connected between the inner wall of the kiln and the outer wall of the retort, and the filter cartridge extends from the chamber of the retort, through the sleeve, and out of the kiln such that the filter cartridge is removable from the gas recovery system from outside the kiln.

In one embodiment, the retort further includes a transversal member extending across the chamber of the retort, the transversal member being hollow and adapted to allow flow of the hot air therethrough to fluidly connect a first side of the hot air plenum with a second side of the hot air plenum.

In one embodiment, the transversal member is located vertically below the filter cartridge, the filter cartridge is a first filter cartridge and the pyrolysis system further includes a second filter cartridge located vertically offset of the first filter cartridge, and the transversal member is located vertically below the second filter cartridge.

In one embodiment, the transversal member has a first outer diameter, the filter cartridge has a second outer diameter, and the first outer diameter is greater than the second outer diameter.

In one embodiment, the filter cartridge extends along a filter cartridge axis, and the transversal member extends along a transversal member axis, the filter cartridge axis being parallel to the transversal member axis and vertically offset the transversal member axis.

In one embodiment, the filter cartridge has at least one wall defining a plurality of holes, the plurality of holes defined on the at least one wall of the filter cartridge having a combined area corresponding between 20% and 40% of an area of the at least one wall.

In one embodiment, the retort has an upper portion and a lower portion, and the filter cartridge extends in the lower portion proximate the outlet.

In one embodiment, the upper portion is cylindrically shaped, and the lower portion is frustoconically shaped with a narrower end proximate the outlet.

In one embodiment, an angle defined between a longitudinal axis of the retort and a wall of the lower portion is comprised between 35° and 70°.

In one embodiment, the port is a first port, the filter cartridge is a first filter cartridge, the first filter cartridge extends in the lower portion of the retort, and the retort further includes a second port located vertically higher than the first port, and a second filter cartridge located vertically higher than the first filter cartridge, the second filter cartridge extending in the upper portion of the retort.

In one embodiment, the pyrolysis system further includes a valve fluidly connected to the port of the retort for isolating the filter cartridge from the conduit.

In another aspect, there is provided a method for operating a pyrolysis system for converting carboneous materials into biochar, the method including conveying pyrolysis gas and residues from a chamber of a retort to a gas recovery system, removing a first filter cartridge from the chamber of the retort through a port of the retort, and inserting a second filter cartridge in the chamber of the retort through the port of the retort.

In one embodiment, the inserting of the second filter cartridge is made through a sleeve connected between an inner wall of a kiln and an outer wall of the retort of the pyrolysis system.

In one embodiment, the removing and the inserting are made along a cartridge filter axis, and a transversal member of the retort defines a transversal member axis extending parallel and vertically below the cartridge filter axis.

In yet another aspect, there is provided a method for operating a pyrolysis system for converting carboneous materials into biochar, the method including closing an inlet valve and an outlet valve of a retort located inside a kiln and affixed thereto, starting a combustor for supplying hot air to the kiln, opening the inlet valve of the retort, providing the carboneous materials inside the retort through the inlet valve, closing the inlet valve, supplying the hot air to the kiln, opening gate valves of a gas recovery system for fluidly connecting a chamber of the retort to the combustor, converting the carboneous materials inside the chamber of the retort into biochar, and opening the outlet valve of the retort for emptying the biochar from the retort.

In one embodiment, the method further includes filtering pyrolysis gas and residues from the carboneous materials in the gas recovery system during the converting of the carboneous materials into biochar.

In yet another aspect, there is provided a filter cartridge for a pyrolysis system including a body having at least one wall, and a plurality of holes defined in the at least one wall, the plurality of holes defined in the at least one wall of the body having a combined area corresponding between 20% and 40% of an area of the at least one wall.

In one embodiment, the body is cylindrically shaped, and the plurality of holes defined in the at least one wall are oblong holes, each oblong holes having a length ranging between 3 in (76.2 mm) and 5 in (127.0 mm), and a width ranging between ⅛ in (3.2 mm) and ⅜ in (9.5 mm).

Further details of these and other aspects of the subject matter of this application will be apparent from the detailed description included below and the drawings.

DESCRIPTION OF THE DRAWINGS

Reference is now made to the accompanying drawings, in which.

DETAILED DESCRIPTION

The following disclosure generally describes a pyrolysis system 20 being an embodiment of the present technology. It is to be expressly understood that the pyrolysis system 20 is merely a preferred embodiment of the present technology. The description thereof that follows is intended to be only a description of a physical example of the technology. This description is not intended to define the scope or set forth the bounds of the technology. In some cases, what are believed to be helpful examples of modifications to the pyrolysis system 20 are also set forth hereinbelow. This is done merely as an aid to understanding, and, again, not to define the scope or set forth the bounds of the technology. These modifications are not exhaustive, and, as a person skilled in the art would understand, other modifications are likely possible. Further, it should not be interpreted that where this has not been done, i.e. where no examples of modifications have been set forth, that no modifications are possible and/or that what is described is the sole physical means of embodying that element of the technology. As a person skilled in the art would understand, this is likely not the case.

Figure 1:
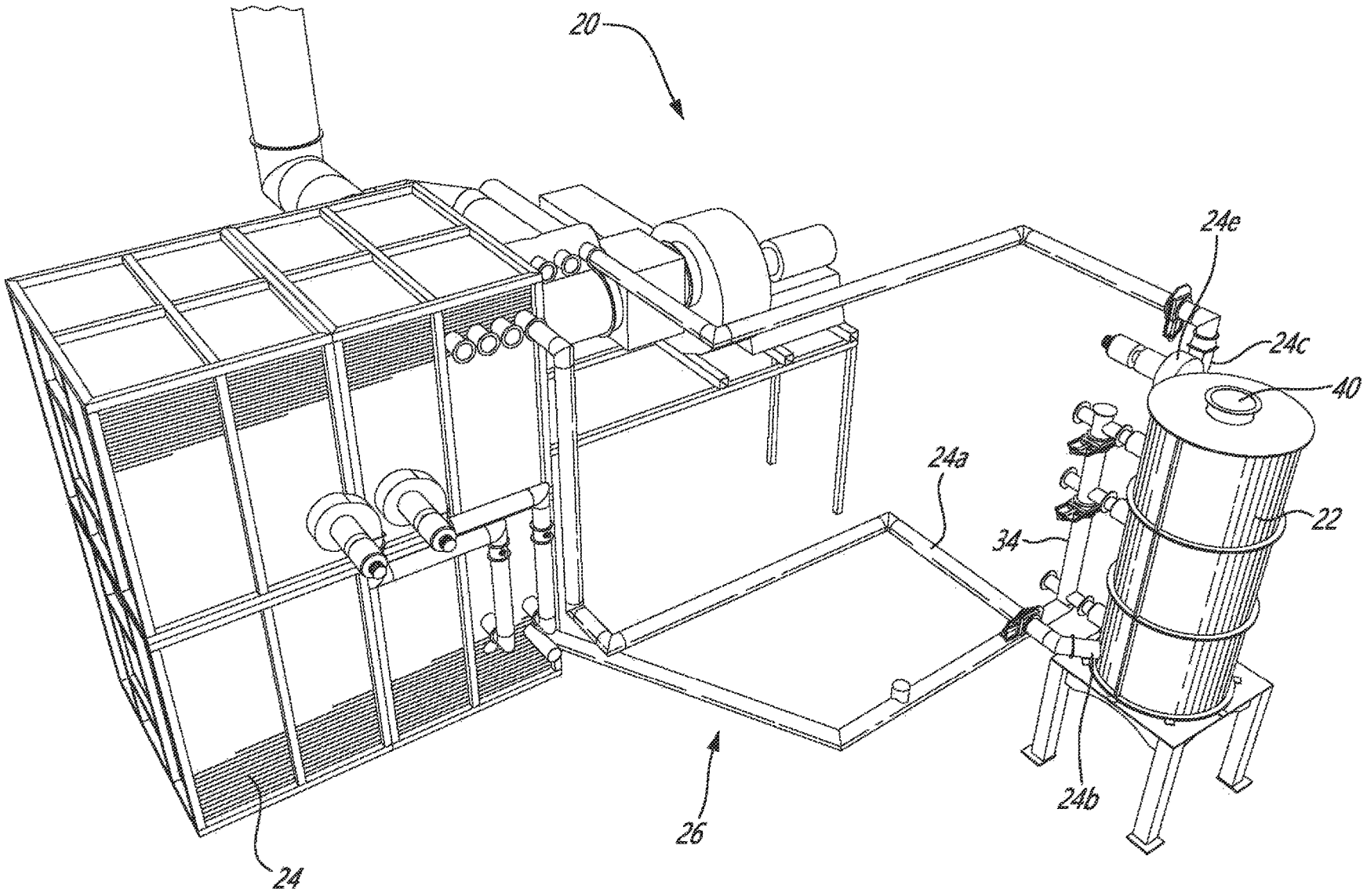
FIG. 1 is a perspective view taken from a top, front, left side of a pyrolysis system in accordance with one embodiment of the present technology.

Referring to FIG. 1, the pyrolysis system 20 is adapted for producing biochar from carboneous materials including, and not limited to, wood chips and agricultural waste products and other organic materials. The pyrolysis system 20 is adapted for converting the carboneous materials into biochar having a carbon content ranging from 70%-wt to 93%-wt. The pyrolysis process (also referred to as thermo-conversion) occurs in the pyrolysis system 20 by controlling, among other parameters, the temperature, atmosphere, moisture content, residence time and pressure undergone by the carboneous materials. For instance, in some embodiments, the temperature is generally comprised between 300° C. and 600° C., depending on, among various parameters, the residence time of the carboneous materials.

Figure 2:
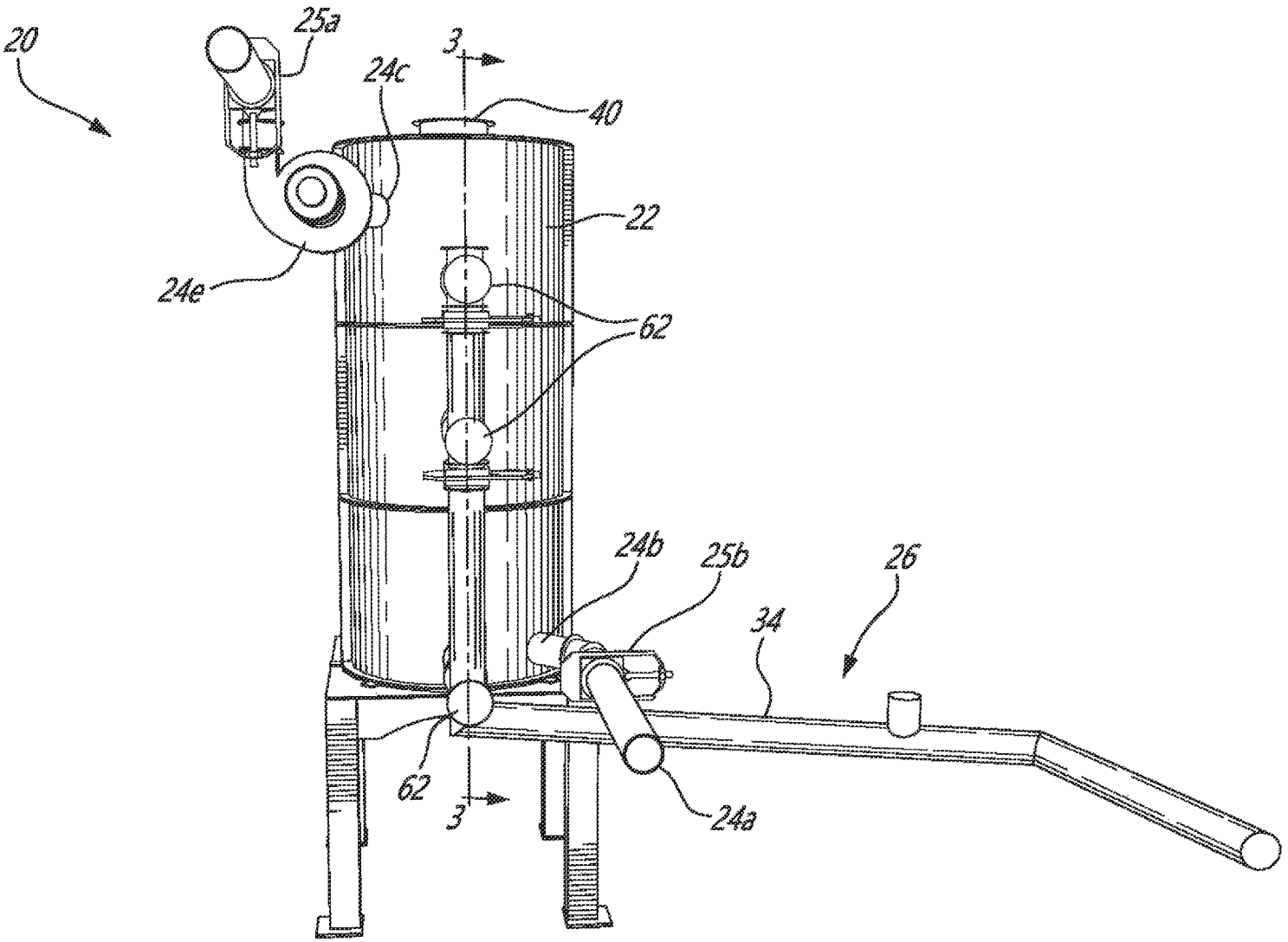
FIG. 2 is a rear elevation view of a portion of the pyrolysis system of FIG. 1 including a kiln and a retort.
Figure 3:
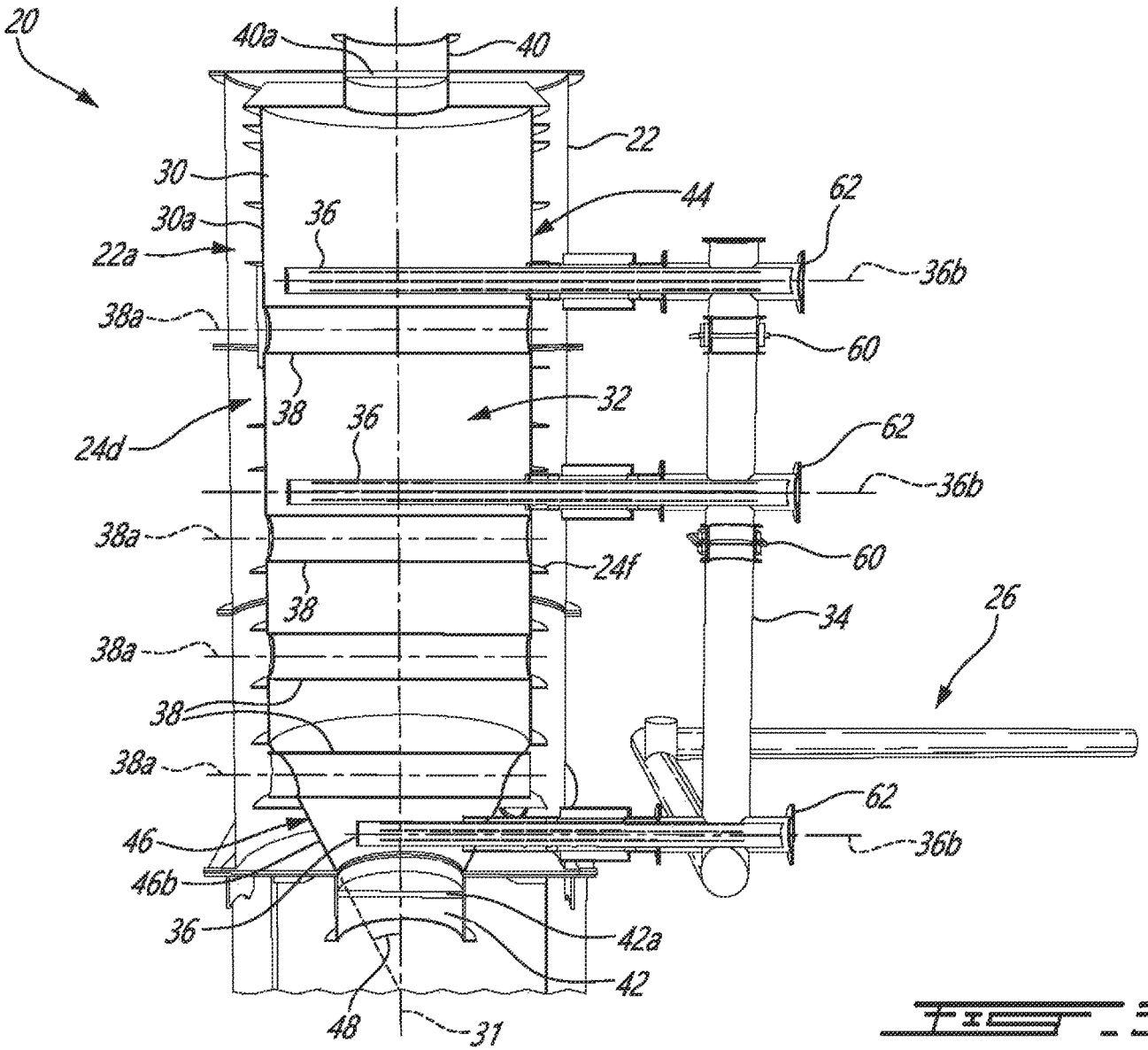
FIG. 3 is a cross-sectional view of the portion of the pyrolysis system of FIG. 2 taken along cross-section line 3-3 of FIG. 2.

Referring to FIGS. 1 to 3, the pyrolysis system 20 will be generally described. The pyrolysis system 20 includes a kiln 22 adapted for containing hot air and/or other hot gases supplied by a combustor 24 that is part of a gas recovery system 26. A hot air line 24*a* is fluidly connected from the combustor 24 to the kiln 22 for supplying the hot air and/or other hot gases to an inner volume of the kiln 22. The combustor 24 includes a burner (not shown) adapted to burn suitable fuel(s), such as propane, and/or pyrolysis gases and residues, such as syngas, tarry by-products, phenolics and bio-oil, generated during the thermo-conversion of the carboneous materials and recovered by the gas recovery system 26. The combustor 24 operates under vacuum and at a temperature ranging between 500° C. and 1000° C. In one example, the hot air enters the kiln 22 at a hot air inlet 24*b* through a hot air inlet valve 25*a* at a temperature of about 700° C. The hot air exits the kiln 22 at a hot air outlet 24*c* through a hot air outlet valve 25*b* at a temperature of about 300° C. A retort 30 (FIG. 3) is located inside the kiln 22 and is affixed to the kiln 22. The retort 30 defines a chamber 32 in which the carboneous materials are placed for pyrolysis and converted into biochar. The gas recovery system 26 further includes a conduit 34 fluidly connected between the chamber 32 of the retort 30 and the combustor 24. The conduit 34 conveys the pyrolysis gas and residues from the chamber 32 of the retort 30 to the combustor 24 for combustion thereof, which may improve the overall efficiency of the pyrolysis system 20 in some circumstances. The gas recovery system 26 further includes filter cartridges 36 fluidly connecting the chamber 32 of the retort 30 to the conduit 34 for filtering the pyrolysis gas and the residues conveyed from the chamber 32 of the retort 30 to the combustor 24. Each of the filter cartridge 36 is removably located inside the conduit 34 and extends at least partially inside the chamber 32 of the retort 30.

Figure 4:
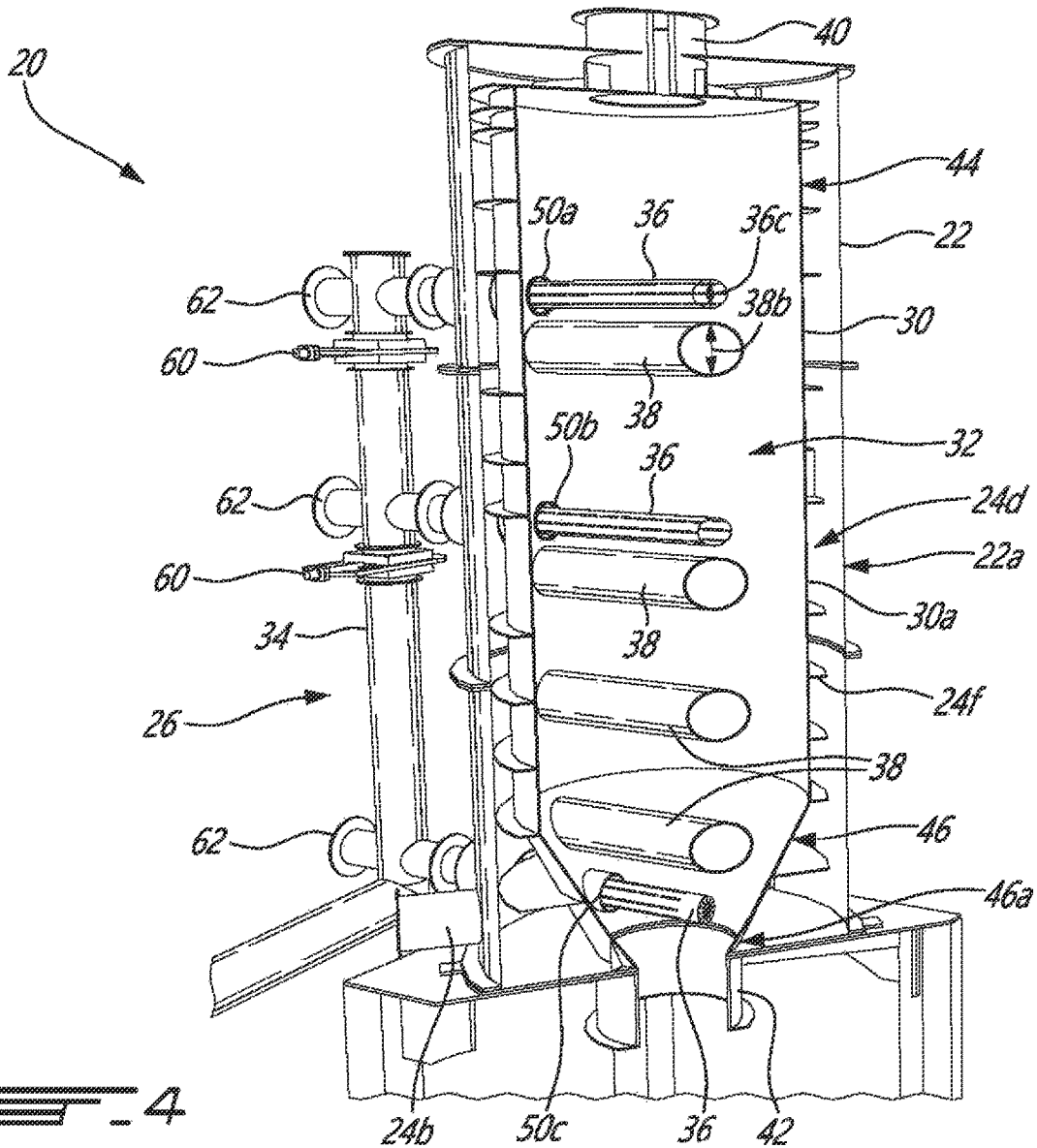
FIG. 4 is a perspective, cross-sectional view of the portion of the pyrolysis system of FIG. 2.

Referring to FIGS. 3 and 4, the kiln 22 and the retort 30 will be further described. In contrast with batch-type pyrolysis systems, the retort 30 is not meant to be removable from the kiln 22 at the end of a pyrolysis cycle. The retort 30 is affixed to the kiln 22 using suitable fasteners and/or suitable bonding techniques, such as welding. The retort 30 and the kiln 22 define a longitudinal, vertical axis 31 (FIG. 3) extending in a center of the kiln 22 and the retort 30.

As will become apparent from the following description, the retort 30 is configured for indirect heat transfer from the hot air flowing inside the kiln 22 to the carboneous materials located inside the chamber 32 of the retort 30. Furthermore, the retort 30 and the gas recovery system 26 are adapted to isolate the carboneous materials from direct contact with the hot air flowing inside the kiln 22.

Still referring to FIGS. 3 and 4, an inner wall 22*a* of the kiln 22 and an outer wall 30*a* of the retort 30 are spaced apart. Although not depicted in the accompanying drawings, insulating materials, such as ceramic wool components and/or refractory materials, are provided on the inner wall 22*a* of the kiln 22. The outer wall 30*a* of the retort 30 is located inwardly from the inner wall 22*a* of the kiln 22 relative to the axis 31. The inner wall 22*a* of the kiln 22 and the outer wall 30*a* of the retort 30 define a hot air plenum 24*d*. A fan 24*e* (FIG. 2) draws the hot air flowing from the hot air inlet 24*b* in the hot air plenum 24*d* through a series of baffles 24*f* connected to the outer wall 30*a* of the retort 30. The baffles 24*f* create a tortuous path for the hot air and provide that the hot air remains in contact for a sufficient amount of time with the outer wall 30*a* of the retort 30 to provide for adequate heat transfer from the hot air to the outer wall 30*a* of the retort 30, and on to the carboneous materials located inside the chamber 32. The baffles 24*f* are spaced from the insulating materials provided on the inner wall 22*a* of the kiln 22.

As best seen in FIG. 4, the retort 30 further includes transversal members 38 extending across the chamber 32 of the retort 30. The transversal members 38 are hollow and are adapted to allow flow of the hot air therethrough to fluidly connect one side of the hot air plenum 24*d* to another side of the hot air plenum 24*d* (i.e. on a opposite side of the axis 31). Since the hot air flows through the transversal members 38, the carboneous materials located inside the chamber 32 and adjacent the axis 31 also receive heat from the hot air through the walls of the transversal members 38. The transversal members 38 thus facilitate heat transfer from the hot air to the carboneous materials that may be located in a central region (i.e. adjacent the axis 31) of the chamber 32 of the retort 30. Each of the transversal members 38 further defines a respective transversal member axis 38*a* that intersects the longitudinal axis 31. In other embodiments, the transversal member axis 38*a* may be laterally offset from the longitudinal axis 31, and/or extend at an angle in a plane containing the longitudinal axis 31.

Still referring to FIGS. 3 and 4, the retort 30 includes an inlet 40 for filling the chamber 32 of the retort 30 with the carboneous materials. An air-tight, high-temperature inlet valve 40*a* (schematically shown) is located in the inlet 40 to hermetically seal off the chamber 32 upon closing the inlet valve 40*a*. The retort 30 further includes an outlet 42 located vertically below the inlet 40 for emptying the biochar from the chamber 32 through gravity. An air-tight, high-temperature outlet valve 42*a* (schematically shown) is located in the outlet 42 to hermetically seal off the chamber 32 upon closing the outlet valve 42*a*. For filling the chamber 32 with the carboneous materials, the outlet valve 42*a* is closed and the inlet valve 40*a* is open so as to allow passage to carboneous materials flowing from above the retort 30 and kiln 22. For emptying the chamber 32, the outlet valve 42*a* is opened and the biochar is allowed to flow underneath the retort 30 and kiln 22. The outlet 42 is spaced from a ground surface, and it is contemplated that, upon opening the outlet valve 42*a*, the biochar is collected into a suitable container or on a conveyor belt system carrying the biochar away for further processing. It is also contemplated that, in some embodiments, the pyrolysis system 20 has the capability to introduce airflow at the end of the pyrolysis cycle while the biochar is still hot to force the adsorption of oxygen into the porous structure of the biochar and improve its resistance to self-heating. Self-heating occurs when there is a chemical reaction between the biochar and the oxygen present in the air without an external source of heat. Self-heating depends on many parameters, such as and not limited to, the moisture content of the biochar, the particles size, and the surface in contact with the air.

For instance, the inlet valve 40*a* can be cracked open to allow flow of air (and oxygen) inside the chamber 32 of the retort 30 at the end of a cycle. During this post-treatment phase, the gases are still sucked into the combustor 24 to eliminate gas emission outside the pyrolysis system 20. Under certain conditions, the input of oxygen inside the chamber 32 of the retort 30 permits burning of at least some pyrolysis gas and residues, thus promoting the formation of biochar with desirable properties. For examples, the oxygenation produced by the inlet valve 40*a* being opened improves the resistance to self-heating. The burned tars promotes the emanation of pyrolytic gas by combustion thereof. One of the advantages of the pyrolysis system 20 is that the suction of the gases produced by the combustor 24 allows the pyrolysis gas and residues gases to be captured in the gas recovery system 26.

As the chamber 32 of the retort 30 is filled and emptied using gravity, there is no need for moving parts conveying the carboneous materials and/or the biochar produced from pyrolysis, which may improve reliability compared to other pyrolysis systems. There is also no need for moving the retort 30 out of the kiln 22 for further processing, i.e. cool down step(s). The elimination of the cooling step(s) and of the withdrawal/insertion of a retort inside a kiln increase productivity and lead to shorter pyrolysis cycle time and the reduction of thermal stress on the components of the pyrolysis system 20 compared to other pyrolysis systems.

Still referring to FIGS. 3 and 4, the retort 30 has an upper portion 44 and a lower portion 46. The upper portion 44 is cylindrically shaped, and the lower portion 46 is frustoconically shaped with a narrower end 46*a* proximate the outlet 42. It is contemplated that an angle 48 (FIG. 4) defined between the longitudinal axis 31 and a wall 46*b* of the lower portion 46 is comprised between 35° and 70°. Such downward frustoconical shape acts as a funnel to direct the carboneous materials towards the outlet 42. In addition, the downward frustoconical shape provides that there is less distance between the hot air plenum 24*d* and the longitudinal axis 31 in the lower portion 46 than in the upper portion 44 of the retort 30, which may improve heat transfer from the hot air flowing in the hot air plenum 24*d* to the carboneous materials located inside the chamber 32 in the lower portion 46 and in a central region thereof (i.e. adjacent the longitudinal axis 31). Put differently, the downward frustoconical shape of the retort 30 promotes flow of the biochar toward the outlet 42, and reduce a distance between the hot air contained in the kiln 22 and the carboneous materials located in a central region of the lower portion 46 of the retort 30. Since the source of heat (i.e. the hot air) is closer to the carboneous materials, the pyrolysis process is promoted in the central region of the lower portion 46 of the retort 30, which leads to a better homogeneity of the biochar produced.

Referring to FIGS. 1 to 4, the filter cartridges 36 and the conduit 34 conveying the pyrolysis gas and residues from the chamber 32 of the retort 30 to the combustor 24 will be described in detail. The conduit 34 is fluidly connected to vertically spaced apart ports 50*a*, 50*b*, 50*c* (FIG. 4) defined in the retort 30 and fluidly connected to the chamber 32. The ports 50*a*, 50*b*, 50*c* and the conduit 34 are adapted for conveying the pyrolysis gas and the residues out of the chamber 32 of the retort 30 during the pyrolysis process to, amongst various considerations, avoid contamination of the biochar with such pyrolysis gas and residues and improve the self-heating resistance of the biochar produced using the pyrolysis system 20.

A filter cartridge 36 having a cylindrically-shaped body 36*a* (FIG. 6) extends through each one of the ports 50*a*, 50*b*, 50*c* and partially inside the chamber 32 of the retort 30 along a respective filter cartridge axis 36*b*. The filter cartridges 36 have similar configuration, except for the filter cartridge 36 extending in the lower portion 46 of the retort 30 which is shorter than the filter cartridges 36 that extend in the upper portion 44 of the retort 30. As the ports 50*a*, 50*b*, 50*c* are vertically spaced apart, it is contemplated that different pyrolysis gas and residues can be collected through the different filter cartridges 36. For instance, in the depicted embodiment where three filter cartridges 36 are vertically spaced apart, pyrolysis gas and residues having different properties (density, viscosity, etc.) can be captured by the gas recovery system 26 through the filter cartridges 36, and reduce contamination of the biochar with the pyrolysis gas and residues. The residues are, in some embodiments, tarry by-products formed during the pyrolysis process by the condensation of the pyrolysis gas and humidity present in the carboneous materials.

Figure 6:
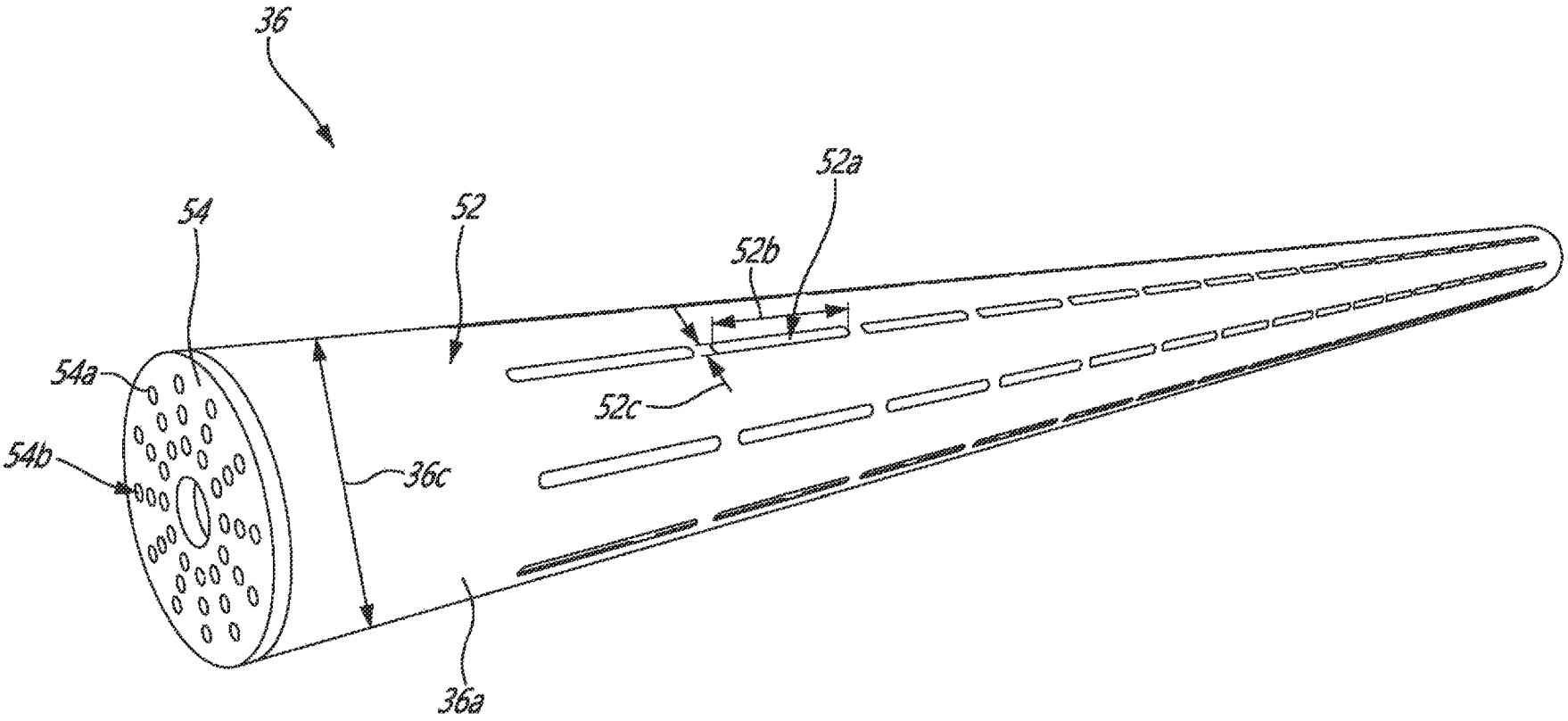
FIG. 6 is a perspective view of a filter cartridge of the pyrolysis system of FIG. 1.

Referring to FIG. 6, the filter cartridges 36 are adapted for allowing passage of the pyrolysis gas and residues from the chamber 32 into the filter cartridge 36 and on to the conduit 34 while blocking a majority of the particles of carboneous materials from entering the filter cartridge 36. To this effect, each filter cartridge 36 has the cylindrical wall 52 and the end walls 54 defining a plurality of holes 52*a*, 54*a* respectively. The holes 52*a* are oblong holes with a length 52*b* ranging between 3 in (76.2 mm) and 5 in (127.0 mm), and a width 52*c* ranging between ⅛ in (3.2 mm) and ⅜ in (9.5 mm). The holes 54*a* are round holes with a diameter 54*b* ranging between ⅛ in (3.2 mm) and ⅜ in (9.5 mm). The end wall 54 extending adjacent the inner wall of the retort 30 is spaced from the inner wall of the retort 30 so as to no obstruct the holes 54*a*. Other sizes and shaped for the holes 52*a*, 54*a* are contemplated in other embodiments. The holes 52*a*, 54*a* are sized and shaped to block a majority of the particles of carboneous materials from entering the filter cartridge 36, and could therefore be dimensioned and shaped otherwise according the particles size and shape. The holes 52*a*, 54*a* thus allow for the pyrolysis gas and residues to flow in the gas recovery system 26, and keep the particles forming the carboneous materials inside the chamber 32 of the retort 30 for producing biochar. In the present embodiment, the holes 52*a*, 54*ab* defined on the cylindrical wall 52 and the end walls 54 of the filter cartridge 36 have a combined area corresponding between 20% and 40% of an outer area of the cylindrical wall 52 and the end walls 54. Having such proportion of apertures over the total area of the cylindrical wall 52 and the end walls 54 maintains structural integrity of the filter cartridge 36 while allowing passage of the pyrolysis gas and the residues.

Referring to FIGS. 3 to 6, each of the filter cartridges 36 has an outer diameter 36*c* of ranging between 4 in (101.6 mm) and 5 in (127.0 mm), and each of the transverse members 38 has an outer diameter 38*b* of 8 in (203.2 mm). When the carboneous materials is converted into biochar, the volume occupied by the carboneous materials inside the chamber 32 decreases progressively during the reduction stage, and having the filter cartridges 36 with an outer diameter 36*c* smaller than the outer diameter 38*b* of the transverse members facilitate downward flow of the carboneous materials toward the outlet 42, and limit compaction of the carboneous materials and/or biochar inside the chamber 32.

As best seen in FIG. 3, each of the filter cartridge axes 36*b* extends vertically above a corresponding transversal member axis 38*a*, and each of the filter cartridge axes 36*b* is parallel to the corresponding transversal member axis 38*a*. The portion of each of the filter cartridges 36 extending in the upper portion 44 of the retort 30 is vertically spaced from the corresponding transverse member 38 located directly, vertically below in order to minimize obstruction of the holes 52*a*. In addition, it is contemplated that should a portion of the filter cartridges 36 extending in the upper portion 44 of the retort 30 bend due to thermal fatigue and/or thermal expansion, the filter cartridge 36 would abut the transverse member 38 located directly, vertically below, and the filter cartridge 36 would therefore be supported by the transverse member 38.

Figure 5:
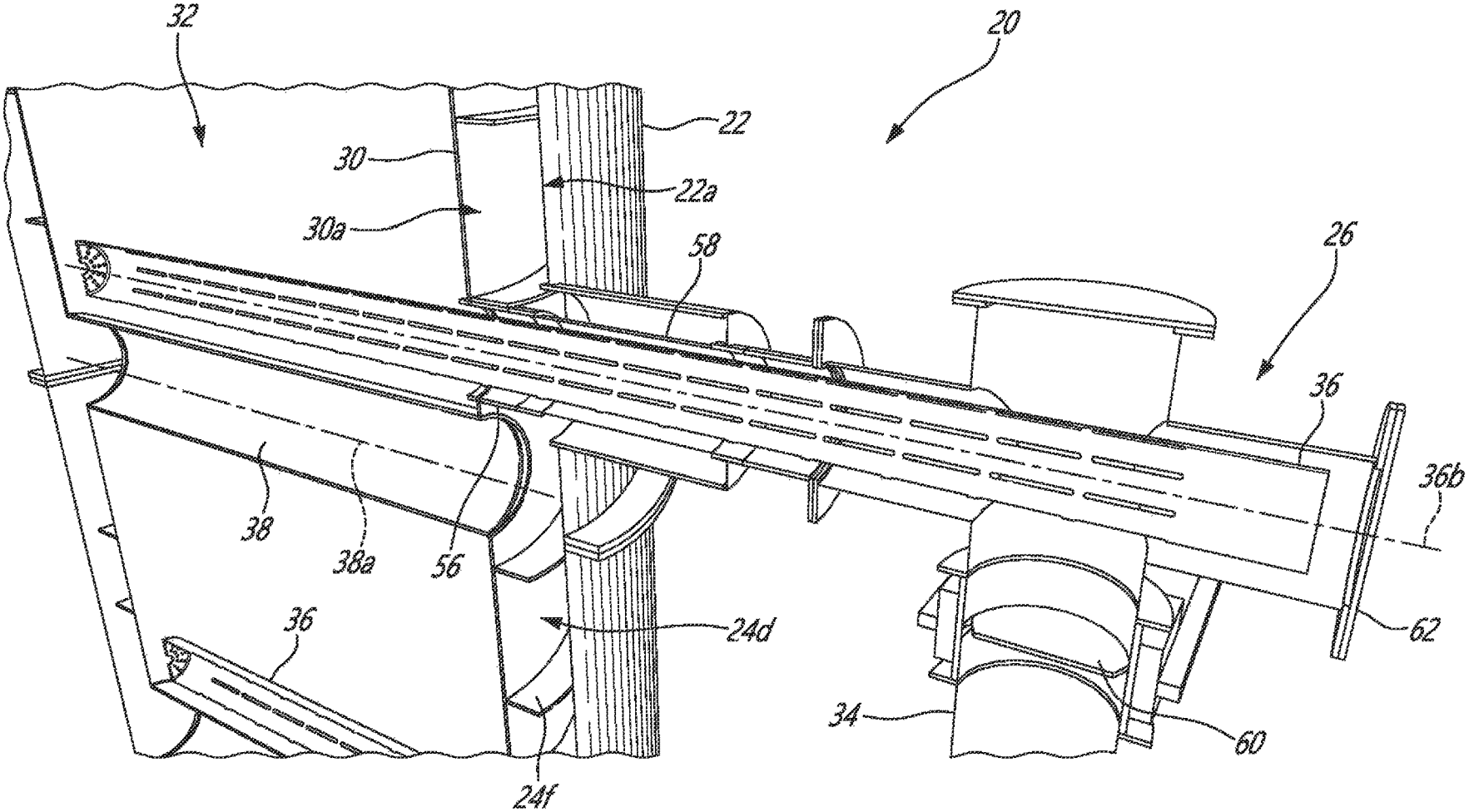
FIG. 5 is an enlarged, perspective cross-sectional view of a portion of FIG. 3.

As best seen in FIG. 5, a sleeve 56 is connected to the inner wall 22*a* of the kiln 22 and to the outer wall 30*a* of the retort 30 in a hermetically sealed manner to prevent the hot air flowing in the hot air plenum 24*d* from entering the filter cartridges 36 through the holes 52*a* and be in direct contact with the pyrolysis gas and residues flowing in a given filter cartridge 36. Hence, the hot air is not in direct contact with the pyrolysis gas and residues flowing in any one of the filter cartridges 36. Still referring to FIG. 5, a flexible jacket 58 surrounds each of the filter cartridges 36 at a location being radially outwardly of the kiln 22, and accommodates for thermal expansion of the kiln 22 and retort 30. Furthermore, each of the filter cartridges 36 extends from the chamber 32 of the retort 30, through the corresponding sleeve 56 and flexible jacket 58, and out of the kiln 22 such that each of the filter cartridges is removable from the gas recovery system 26 from outside the kiln 22.

Figure 7:
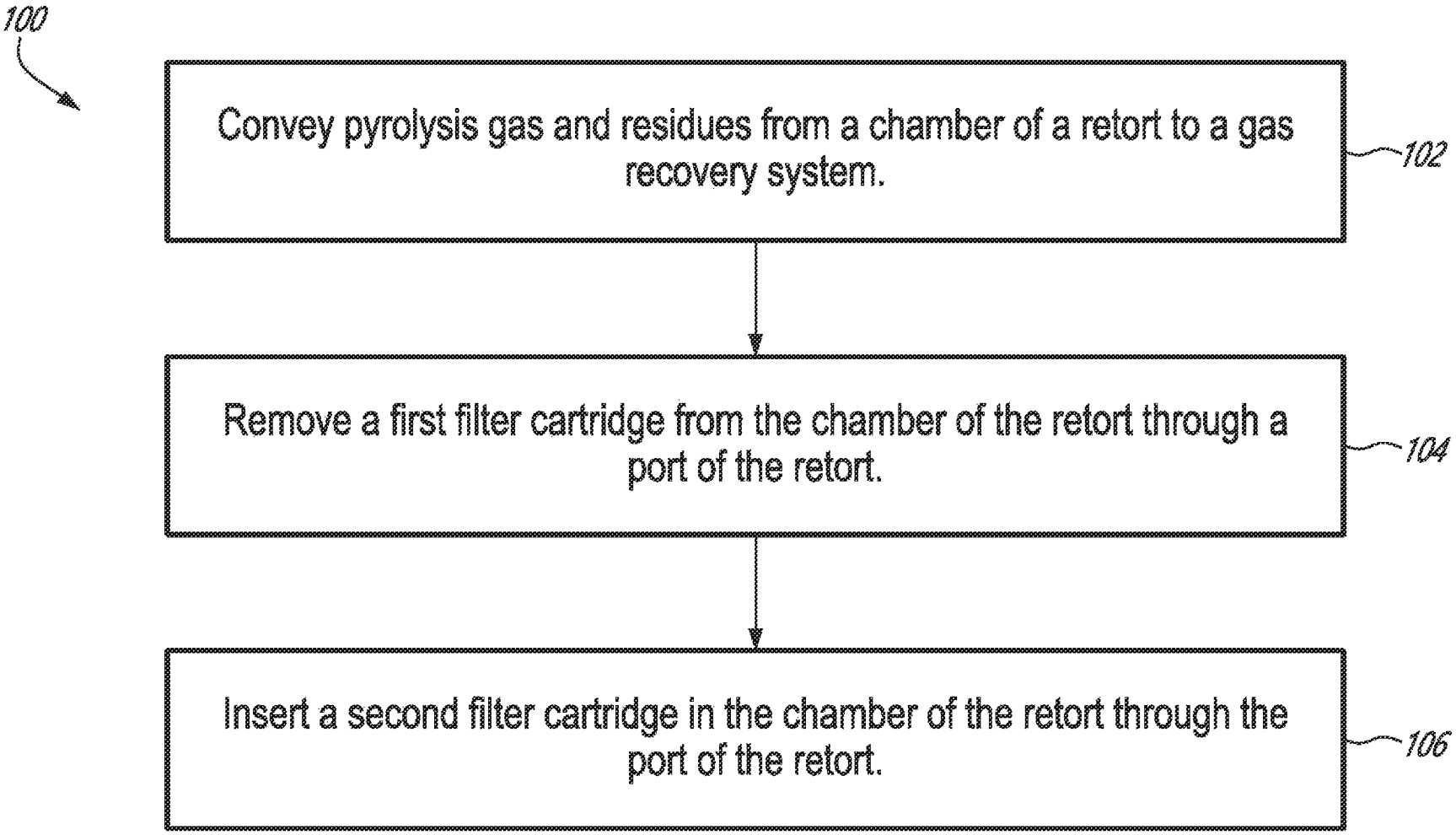
FIG. 7 is a flowchart of a method for operating a pyrolysis system in accordance with one embodiment of the present technology.

With additional reference to FIG. 7, there is provided a method 100 for operating the pyrolysis system 20. At step 102, during the pyrolysis process, the pyrolysis gas and residues are conveyed from the chamber 32 of the retort 30 to the gas recovery system 26 through the filter cartridges 36 and through the conduit 34. Over time, some of the residues may form tar-like compounds and clog at least some of the holes 52*a*, 54*a* of the filter cartridges 36, which in turn limit the egress of the pyrolysis gas and residues inside the filter cartridges 36. At step 104, the method 100 provides for removing any one of the filter cartridges 36 that may become clogged from the chamber 32 of the retort 30, and, at step 106, inserting a replacement filter cartridge 36 that is clean (i.e. without a buildup of pyrolysis residues) for replacing the clogged filter cartridge 36. In some embodiments, the removing (step 104) of the clogged filter cartridge 36 occurs while maintaining temperature and conditions inside the chamber 32 of the retort 30 for performing pyrolysis, and the inserting (step 106) of the replacement filter cartridge 36 also occurs while maintaining temperature and conditions inside the chamber 32 of the retort 30 for performing pyrolysis.

It is contemplated that when a clogged filter cartridge 36 is removed from the chamber 32 of the retort 30, the clogged filter cartridge 36 is subsequently cleaned and made available for insertion inside the chamber 32 of the retort 30. It is thus contemplated that for performing the method 100 with the pyrolysis system 20, multiple filter cartridges 36 can be available to operators that would monitor the gas recovery system 26, and the operators could replace clogged filter cartridges 36 with clean filter cartridges 36 as needed, whether between pyrolysis cycles or during a pyrolysis cycle. Therefore, it is contemplated that the pyrolysis system 20 does not need to stop the pyrolysis process and/or to lower the temperature sufficiently to stop the pyrolysis process in order for replacing any one of the filter cartridges 36. It is also contemplated that should the clogged filter cartridge 36 be damaged or need replacement, a new filter cartridge 36 could be provided as a replacement.

In an exemplary scenario, to remove a clogged filter cartridge 36 from the conduit 34, a gate valve 60 fluidly connected to the corresponding port 50*a*, 50*b*, 50*c* is closed to isolate the clogged filter cartridge 36 from the conduit 34. A hatch 62 corresponding to the clogged filter cartridge 36 is opened, and the clogged filter cartridge 36 is removed from the chamber 32 of the retort 30, the sleeve 56 and the flexible jacket 58 and through the hatch 62 along the cartridge filter axis 36*b* (FIG. 5). The sleeve 56, the jacket 58 and the hatch 62 are dimensioned to provide for adequate clearance to remove the filter cartridge 36 despite the presence of pyrolysis residues thereon. A clean filter cartridge 36 is then inserted through the hatch 62, the flexible jacket 58 and the sleeve 56 and on the chamber 32 of the retort 30 along the cartridge filter axis 36*b*. The hatch 62 is closed and the gate valve 60 is opened such that pyrolysis gas and residues flowing inside the filter cartridge 36 are conveyed through the conduit 34 to the combustor 24.

Replacing the filter cartridges 36 on a regular basis, whether while in operation or between pyrolysis cycles, contributes to higher productivity and to the improvement in the resistance to self-heating of the biochar produced. It is contemplated that the gate valve 60 may remain open during the replacement of the filter cartridge 36. The three gate valves 60 depicted herein are also used to control the flow of pyrolysis gas and residues flowing in the conduit 34 and on to the combustor 24. Put differently, the three gate valves 60 allow control of the gas level in the chamber 32 of the retort 30. Thus, for example, upon closing the gate valves 60 corresponding to the upper portion 44 of the retort 30, pyrolysis gas and residues are conveyed in the gas recovery system 26 and on to the combustor 24 through the gate valve 60 corresponding to the lower portion 46 of the retort. The combustor 24 is then fed by the combustion of the syngas produced by the tars. There is therefore no external emanation of syngas, because the syngas are burned inside the combustor 24.

It is to be noted that although three filter cartridges 36 are described and shown herein, it is contemplated that in some other embodiments the pyrolysis system 20 could have fewer or more than three filter cartridges 36. In one embodiment, the pyrolysis system only has one filter cartridge 36, and the filter cartridge 36 is contemplated to extend in the lower portion 44 of the retort 30 so as to be surrounded by carboneous materials during the pyrolysis process.

It is also to be noted that although one kiln 22 and one retort 30 are shown and described herein, multiple kilns 22 with their respective retort 30 could be connected to the combustor 24 and to the gas recovery system 26. For instance, when one retort 30 is producing biochar, the pyrolysis gas and residues conveyed by the gas recovery system 26 are burned in the combustor 24, and the hot air generated can be used to start the pyrolysis process in another retort 30 while the excess heat is evacuated externally to wood dryers or other heat recovery units.

Figure 8:
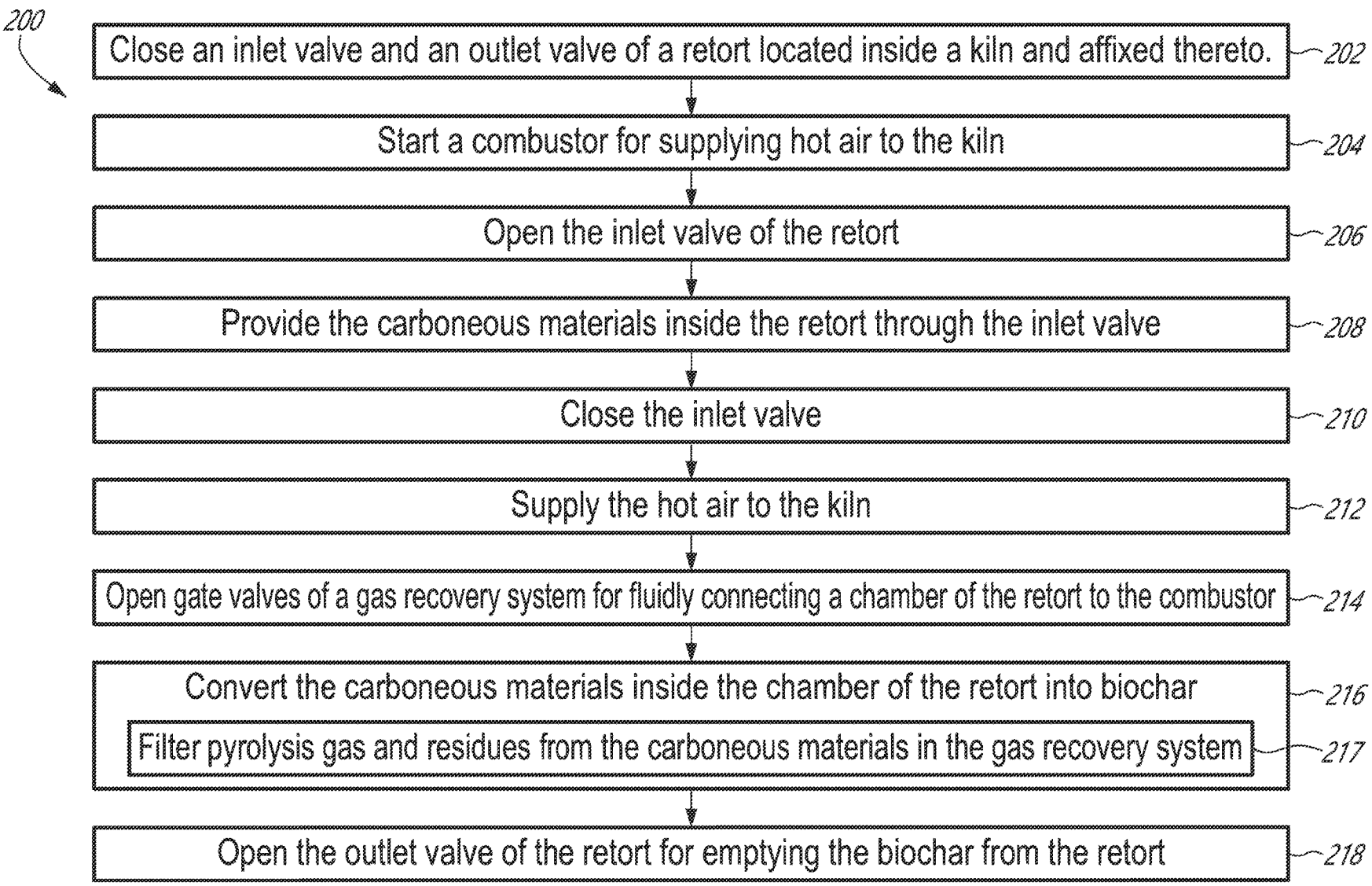
FIG. 8 is a flowchart of another method for operating a pyrolysis system in accordance with one embodiment of the present technology.

Referring now to FIG. 8, another method 200 for operating the pyrolysis system will be described. The method 200 describes at least some steps, i.e. not necessarily all of them, for initiating the pyrolysis process from a cold start of the pyrolysis system 20. At step 202, the inlet valve 40*a*, the outlet valve 42*a* and the gate valves 60 are closed. At step 204, the combustor 24 is started by burning a suitable fuel, such as propane gas, and is controlled to supply the hot air at about 800° C. At step 206, the inlet valve 40*a* is opened. At step 208, the carboneous materials are provided inside the chamber 32 of the retort 30 through the inlet 40 and the inlet valve 40*a*. At step 210, the inlet valve 40*a* and the gate valves 60 are closed. At step 212, the hot air inlet valve 25*a* and the hot air outlet valve 25*b* are opened to supply the flow of hot air in the plenum 24*d*. At step 214, the gate valves 60 are opened for fluidly connecting the chamber 32 of the retort 30 to the combustor 24. The step 214 is contemplated to be performed, in some embodiments, when the temperature in the plenum 24*d* reaches 90° C. At step 216, the pyrolysis of the carboneous materials is performed. It is contemplated that the pyrolysis process begins when the temperature of the carboneous materials reaches about 150° C. In an embodiment where a second retort 30 is fluidly connected to the gas recovery system 26 and the combustor 24, it is contemplated that the pyrolysis gas and residues conveyed in the gas recovery system 26 and burned in the combustor 24 may be used to start the pyrolysis process within the second retort 30. During step 216, the method 200 involves the step 217 of filtering pyrolysis gas and residues from the carboneous materials using the filter cartridges 36, and conveying the pyrolysis gas and residues to the combustor 24 using the gas recovery system 26. When the temperature of the carboneous materials/biochar reaches a plateau ranging between about 250° C. and about 300° C., the pyrolysis cycle is completed. The hot air inlet valve 25*a* and the hot air outlet valve 25*b* are then closed to supplying the hot air to the plenum 24*d*. At step 218, the outlet valve 42*a* is opened to empty the biochar from the chamber 32 of the retort 30. Once emptied, the retort 30 is ready for another pyrolysis cycle.

The embodiments described in this document provide non-limiting examples of possible embodiments of the present technology. Upon review of the present disclosure, a person of ordinary skill in the art will recognize that changes may be made to the embodiments described herein without departing from the scope of the present technology.

What is claimed is:

1. A pyrolysis system for converting carboneous materials into biochar, comprising:

a kiln adapted for containing hot air;

a retort located inside the kiln and affixed to the kiln, the retort including an inlet for filling a chamber of the retort with the carboneous materials, and an outlet located vertically below the inlet for emptying the biochar from the chamber of the retort through gravity, the retort defining a port fluidly connected to the chamber for conveying pyrolysis gas and residues out of the retort; and a gas recovery system including a combustor supplying the hot air to the kiln via a hot air line fluidly connected from the combustor to the kiln;

a conduit fluidly connected between the port of the retort and the combustor, the conduit conveying the pyrolysis gas and residues from the chamber of the retort to the combustor; and a filter cartridge fluidly connecting the chamber of the retort to the conduit for filtering the pyrolysis gas and the residues conveyed from the chamber of the retort to the combustor, the filter cartridge removably located inside the conduit and extending through the port at least partially inside the chamber of the retort.

2. The pyrolysis system of claim 1, wherein the retort comprises an inlet valve on the inlet and an outlet valve on the outlet, and during pyrolysis, hot air flowing in the kiln is isolated from the carboneous materials, the pyrolysis gas and the residues inside located inside the chamber of the retort.

3. The pyrolysis system of claim 1, wherein the retort is configured for indirect heat transfer from the hot air flowing inside the kiln to the carboneous materials located inside the chamber of the retort.

4. The pyrolysis system of claim 1, wherein the kiln has an inner wall, the retort has an outer wall spaced inwardly from the inner wall of the kiln, the inner wall of the kiln and the outer wall of the retort defining a hot air plenum between the inner wall of the kiln and the outer wall of the retort.

5. The pyrolysis system of claim 4, further comprising a sleeve connected between the inner wall of the kiln and the outer wall of the retort, and the filter cartridge extends from the chamber of the retort, through the sleeve, and out of the kiln such that the filter cartridge is removable from the gas recovery system from outside the kiln.

6. The pyrolysis system of claim 4, wherein the retort further includes a transversal member extending across the chamber of the retort, the transversal member being hollow and adapted to allow flow of the hot air therethrough to fluidly connect a first side of the hot air plenum with a second side of the hot air plenum.

7. The pyrolysis system of claim 6, wherein the transversal member is located vertically below the filter cartridge, the filter cartridge is a first filter cartridge and the pyrolysis system further includes a second filter cartridge located vertically offset of the first filter cartridge, and the transversal member is located vertically below the second filter cartridge.

8. The pyrolysis system of claim 6, wherein the transversal member has a first outer diameter, the filter cartridge has a second outer diameter, and the first outer diameter is greater than the second outer diameter.

9. The pyrolysis system of claim 6, wherein the filter cartridge extends along a filter cartridge axis, and the transversal member extends along a transversal member axis, the filter cartridge axis being parallel to the transversal member axis and vertically offset the transversal member axis.

10. The pyrolysis system of claim 1, wherein the filter cartridge has at least one wall defining a plurality of holes, the plurality of holes defined on the at least one wall of the filter cartridge having a combined area corresponding between 20% and 40% of an area of the at least one wall.

11. The pyrolysis system of claim 1, wherein the retort has an upper portion and a lower portion, and the filter cartridge extends in the lower portion proximate the outlet.

12. The pyrolysis system of claim 11, wherein the upper portion is cylindrically shaped, and the lower portion is frustoconically shaped with a narrower end proximate the outlet.

13. The pyrolysis system of claim 12, wherein an angle defined between a longitudinal axis of the retort and a wall of the lower portion is comprised between 35° and 70°.

14. The pyrolysis system of claim 11, wherein the port is a first port, the filter cartridge is a first filter cartridge, the first filter cartridge extends in the lower portion of the retort, and the retort further includes a second port located vertically higher than the first port, and a second filter cartridge located vertically higher than the first filter cartridge, the second filter cartridge extending in the upper portion of the retort.

15. The pyrolysis system of claim 1, further comprising a valve fluidly connected to the port of the retort for isolating the filter cartridge from the conduit.

* * * * *